US008811651B2

(12) United States Patent
Alvarez Ibarra

(10) Patent No.: US 8,811,651 B2
(45) Date of Patent: Aug. 19, 2014

(54) SPEAKER HAVING MULTIPLE COILS

(76) Inventor: Rigoberto Alvarez Ibarra, Nuevas Casas Grandes (MX)

( * ) Notice: Subject to any disclaimer, the term of this patent is extended or adjusted under 35 U.S.C. 154(b) by 0 days.

(21) Appl. No.: 13/476,245

(22) Filed: May 21, 2012

(65) Prior Publication Data

US 2013/0108100 A1 May 2, 2013

(51) Int. Cl.
*H04R 1/00* (2006.01)
*H04R 9/06* (2006.01)

(52) U.S. Cl.
USPC ..... 381/401; 381/423

(58) Field of Classification Search
USPC ..... 381/182, 401, 433
See application file for complete search history.

(56) References Cited

U.S. PATENT DOCUMENTS 6,879,700 B2 * 4/2005 Matsudo et al. ..... 381/433
7,551,746 B2 * 6/2009 Sagren ..... 381/182

* cited by examiner

*Primary Examiner* — Brian Ensey
(74) *Attorney, Agent, or Firm* — Weiss & Moy, P.C.; Jeffrey D. Moy

(57) ABSTRACT

A speaker enclosure has an enclosure having an open front section. A partition is formed in the enclosure. A cone is coupled to the partition, wherein an outer perimeter of the cone is unattached from the enclosure forming a gap between the outer perimeter of the cone and the enclosure. A coil assembly is coupled to the cone. A magnet unit is coupled to the cone.

11 Claims, 3 Drawing Sheets

SPEAKER HAVING MULTIPLE COILS

RELATED APPLICATION

The present patent application is related to Mexican Patent Application MX/E/2011/075408, filed Oct. 26, 2011, in the name of Applicant, to which priority is claimed.

BACKGROUND

Embodiments of this disclosure relate generally to a speaker and, more specifically, to a speaker formed by a series of coils placed concentrically which generate movement through the reception of electrical impulses, the coils generating identical movements since they receive the same electrical impulse.

A speaker enclosure is what we know currently as a cabinet having a separate loudspeaker therein. The loudspeaker may be comprised of a cylindrical permanent magnet, within which there is a coil that slides without friction and which in turn is attached to a corrugated fabric membrane. The coil may move freely without touching pole ends which may generate a magnetic field that attracts or repels the coil according to the intensity of the electrical impulse that it receives, moving with it the fabric membrane located at the other end attached or glued to a basket. A moving coil is made of coated aluminum or copper winding mounted on top of an aluminum base or any similar material.

Silver wire is commonly used, soldered or tinned to the ends of the coil and attached to the external terminals where the speaker will be connected to sound equipment. The space between the ferrous materials is narrow. Furthermore, the thickness of the magnet and the length of the coil determine the length of the motion of such coil. The parallel alignment between magnet and coil must be kept at all times because if there is friction, it will distort the sound.

The core of the cone of the speaker is a permanent magnet. If the magnet is bigger, the coil will slide with more force as an electrical pulse going through the coil produces a magnetic field. It is recommended that the chassis where the magnet is affixed to be of cast aluminum because when it is stronger, it will allow larger magnets and it will not interfere with the magnetic field of the magnets or the energized coil.

Therefore, it would be desirable to provide a system and method that overcomes the above issues. The speaker would be formed by a series of coils placed concentrically generating movement through the reception of electrical impulses, the coils generate identical movements since they receive the same electrical impulse. Also, the lengths of the coils are the same independent of the impedance used. The speaker is configured specifically for the layout of the coil, generating an increase in power or wattage, besides the ease of withdrawing the basket, it can be configured to the number of coils, with the understanding that the coils may be used individually or connected in series or parallel according the ohms required.

SUMMARY

A speaker has at least one pair of concentric magnets. A ferrous material is positioned between the at least one pair of concentric magnets. At least one pair of coils is provided wherein the at least one coil of the at least one pair of coils is positioned inside the at least one pair of concentric magnets and at least one coil of the at least one pair of coils is positioned outside the at least one pair of concentric magnets. A basket is coupled to the at least one pair of coils.

A speaker has at least one pair of concentric magnets. A ferrous material is positioned between the at least one pair of concentric magnets. A plurality of coils is provided wherein at least one coil is positioned inside the at least one pair of concentric magnets and at least one coil is positioned outside the at least one pair of concentric magnets. A basket is coupled to the plurality of coils.

The features, functions, and advantages may be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
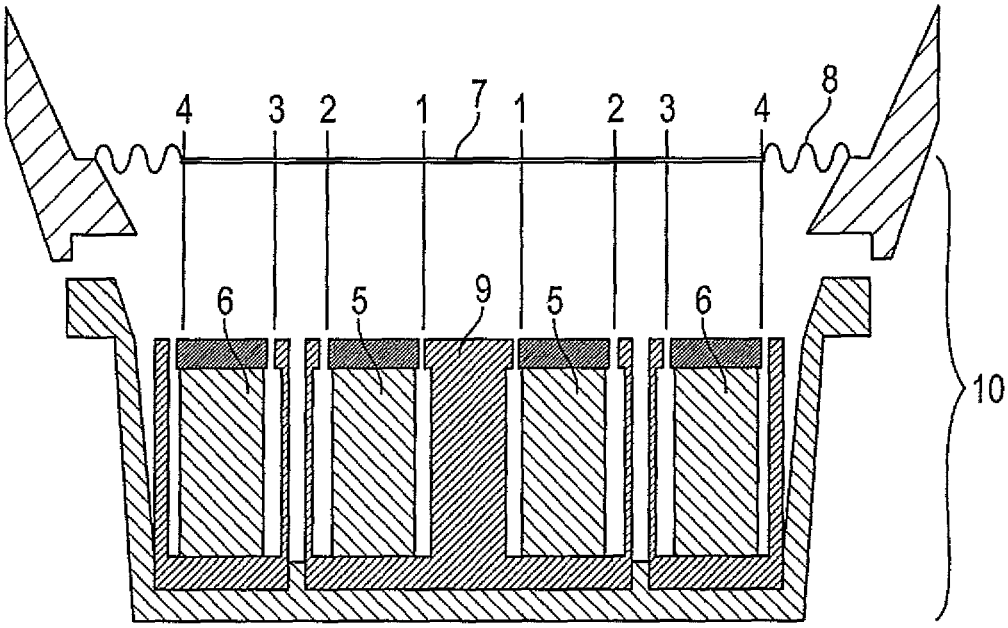
FIG. 1 is a cross section of the front view of the speaker with multiple coils, showing its independent components and without the coils installed.

This invention references a device that produces sounds, specifically a speaker.

The first coil 1 slides as in any other common speaker inside the first magnet 5. The second coil 2 slides outside the first magnet 5. The third coil 3 slides on the outside of the second magnet 6. The coils are joined together by a rigid material 7 either of plastic or something similar that will keep the coils in a parallel position and this material finishes at the coil 4 and immediately joins a corrugated membrane 8 that at the other ends joins the basket of the speaker. This membrane 8 is also known as a centering unit whose function is to center the coils in such a way that when they are in motion, it will not allow friction between the coils and the ferrous metals 9.

The ferrous metals 9 create a magnetic field between one located north of magnets 5, 6 and the other one on the south of the magnets 5, 6 facing the north pole of the magnets 5, 6 both ferrous materials 9 forming a narrow gap where a coil can slide and cause a small air flow without friction between the coil and the ferrous material 9.

The basket 10 and the sheath 12 of the magnetic units or magnets 5, 6 is preferably of aluminum alloy because it provides good strength and also it will not affect the field between the two magnets 5, 6 and the magnetic field formed between the coils when the four coils are energize by an electric pulse. Also the sheath 12 as can be seen in FIG. 2 of 4 situates the ferrous material 9 at the base with limited space that does not allow it to slide.

Figure 2:
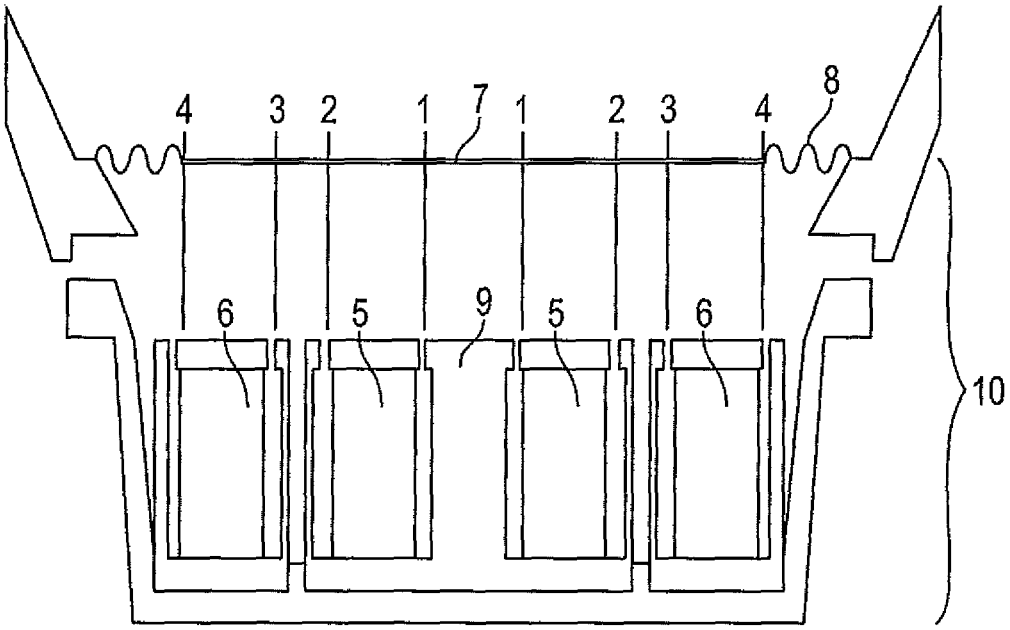
FIG. 2 is a front view of a cross section of the speaker with multiple coils, after installation.
Figure 4:
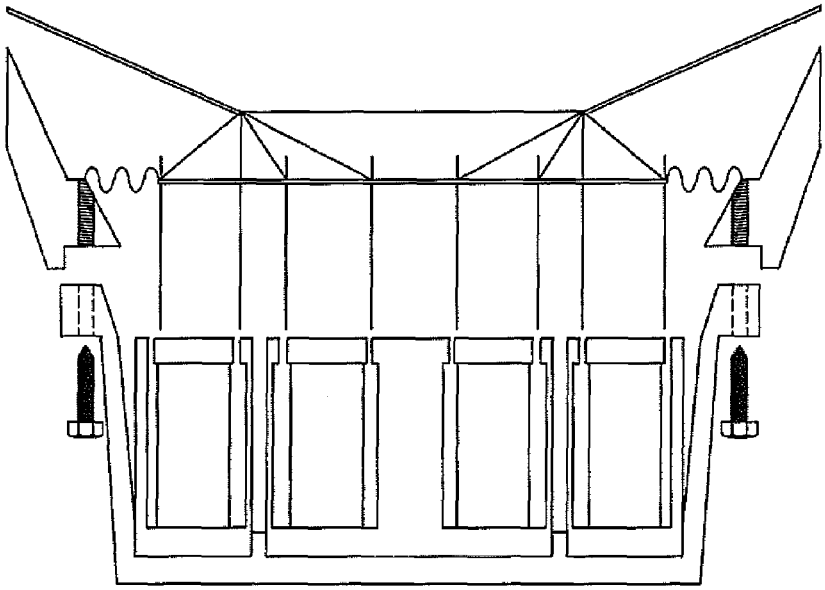
FIG. 4 shows the assemblage of the basket bolted to the magnetic unit, as well as the coupling of the cone to the coils.

As can be seen in FIG. 2 of 4 the basket 10 fits perfectly with the magnetic unit when placing the coils in their corresponding positions the fastening should be through bolts 11 that are distributed symmetrically (octagonally) these will be inserted in the corresponding orifices set in the magnetic unit and will enter the internally threaded orifices, this way allowing the basket to be pulled out as seen in FIG. 4, allowing a change of basket from 12 or 15 inches to an 18 inch basket or vice versa always keeping in mind that the coils as well as the magnet unit will keep the same standard measurement.

Figure 3:
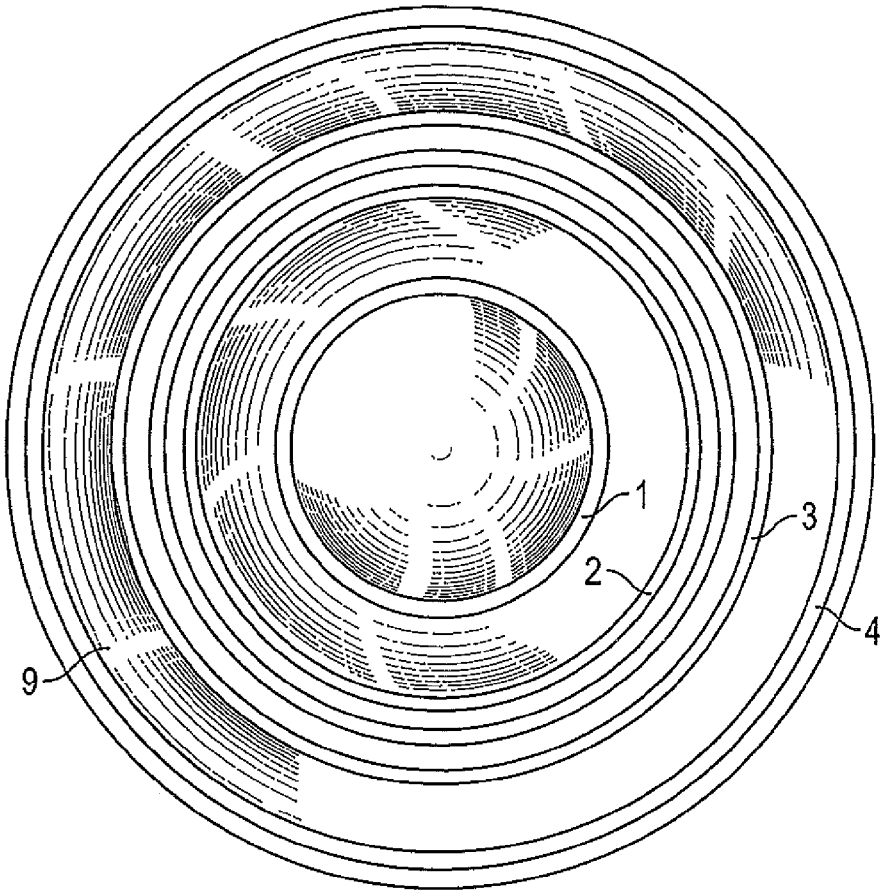
FIG. 3 is a top view of a speaker with multiple coils showing the different coils and their location.

In FIG. 3, the top view will show only the ferrous material 9 on the magnets and the spaces where coils 1, 2, 3, and 4 will be placed.

The objective of this invention is to present a speaker formed by a series of coils placed concentrically generating movement through the reception of electrical impulses, the coils 1, 2, 3, and 4 generate identical movements since they receive the same electrical impulse. Also, the lengths of the coils are the same independent of the impedance used. The speaker is configured specifically for the layout of the coil, generating an increase in power or wattage, besides the ease of withdrawing the basket, it can be configured to the number of coils, with the understanding that the coils may be used individually or connected in series or parallel according the ohms required. For example: there are amplifiers that work and are stable at one ohm, but there are other that are only stable at 8 ohms in such a way that if 4 coils of 4 ohms are set in parallel the ohms will result in on ohm or if they are set in a series, the 4 coils of 2 ohms will result in 8 ohms, given that example the manufacturer could decide the ohms to be applied to each coil according to their needs.

While the invention has been particularly shown and described with reference to preferred embodiments thereof, it will be understood by those skilled in the art that the foregoing and other changes in form and details may be made therein without departing from the spirit and scope of the invention

What is claimed is:

1. A speaker comprising: at least one pair of concentric magnets; a ferrous material positioned between the at least one pair of concentric magnets; a first coil slidable inside a first of the at least one pair of magnets; a second coil slidable on an outside of the first of the at least one pair of magnets; a third coil slidable on an outside of a second of the at least one pair of magnets; a rigid member coupled to the first coil, the second coil and the third coil to keep the first coil, the second coil and the third coil in an approximate parallel position; a basket coupled to the first coil, the second coil and the third coil; and a membrane attached to the rigid member and to the basket.

2. The speaker of claim 1, wherein the ferrous material create a magnetic field between the at least one pair of concentric magnets and forming a narrow gap where at least one coil can slide and cause a small air flow without friction between the coil and the ferrous material.

3. The speaker of claim 1, wherein the basket is formed of a aluminum alloy.

4. A speaker comprising: at least one pair of concentric magnets; a ferrous material positioned between the at least one pair of concentric magnets; a plurality of coils, wherein at least one coil is positioned inside the at least one pair of concentric magnets and at least one coil is positioned outside the at least one pair of concentric magnets; a rigid member coupled to the plurality of coils to keep the plurality of coils in an approximate parallel position; and a basket coupled to the plurality of coils.

5. The speaker of claim 4, further comprising a membrane attached to the rigid member and to the basket.

6. The speaker of claim 4, wherein the ferrous material create a magnetic field between the at least one pair of concentric magnets and forming a narrow gap where at least one coil can slide and cause a small air flow without friction between the coil and the ferrous material.

7. The speaker of claim 4, wherein the basket is formed of an aluminum alloy.

8. The speaker of claim 4, wherein lengths of the plurality of coils is the same independent of the impedance used.

9. A speaker comprising: at least one pair of concentric magnets; a ferrous material positioned between the at least one pair of concentric magnets; a plurality of coils, wherein the at least one coil is positioned inside the at least one pair of concentric magnets and at least one coil is positioned outside the at least one pair of concentric magnets; a basket coupled to the plurality of coils; a rigid member attached to the plurality of coils to keep the plurality of coils in an approximate parallel position; and a membrane attached to the rigid member and to the basket; wherein the ferrous material create a magnetic field between the at least one pair of concentric magnets and forming a narrow gap where at least one coil can slide and cause a small air flow without friction between the coil and the ferrous material.

10. The speaker of claim 9, wherein the basket is formed of a aluminum alloy.

11. The speaker of claim 9, wherein lengths of the plurality of coils is the same independent of the impedance used.

* * * * *